US009566464B2

(12) United States Patent
Ricciardi

(10) Patent No.: US 9,566,464 B2
(45) Date of Patent: Feb. 14, 2017

(54) OMNIDIRECTIONAL EXERCISE DEVICE AND SYSTEM

(71) Applicant: Adam Ricciardi, Mount Vernon, NY (US)

(72) Inventor: Adam Ricciardi, Mount Vernon, NY (US)

( * ) Notice: Subject to any disclaimer, the term of this patent is extended or adjusted under 35 U.S.C. 154(b) by 196 days.

(21) Appl. No.: 13/945,432

(22) Filed: Jul. 18, 2013

(65) Prior Publication Data

US 2015/0024912 A1 Jan. 22, 2015

(51) Int. Cl.

| | |
|---|---|
| ***A63B 21/00*** | (2006.01) |
| ***A63B 21/068*** | (2006.01) |
| ***A63B 21/065*** | (2006.01) |
| ***A63B 22/20*** | (2006.01) |
| ***A63B 23/12*** | (2006.01) |
| *A63B 69/00* | (2006.01) |
| *A63B 23/035* | (2006.01) |

(52) U.S. Cl.

CPC ..... *A63B 21/068* (2013.01); *A63B 21/065* (2013.01); *A63B 21/4035* (2015.10); *A63B 22/20* (2013.01); *A63B 23/1236* (2013.01); *A63B 23/03525* (2013.01); *A63B 23/03541* (2013.01); *A63B 69/004* (2013.01)

(58) Field of Classification Search

CPC ..... A63B 21/00

USPC ..... 482/146, 147, 142, 132, 92

See application file for complete search history.

(56) References Cited

U.S. PATENT DOCUMENTS

| | | | | |
|---|---|---|---|---|
| 5,752,900 A * | 5/1998 | Holland, Jr. | ..... | A63B 21/0004 482/124 |
| 2005/0209072 A1* | 9/2005 | Sheron | ..... | A63B 21/0618 482/132 |

* cited by examiner

*Primary Examiner* — Jerome w Donnelly

(74) *Attorney, Agent, or Firm* — Massina Pat & TM Law PLLC

(57) ABSTRACT

An omnidirectional exercise device including a platform having a top surface and a bottom surface with the top surface extending generally in a first plane. At least one omnidirectional movement assembly is secured relative to the bottom surface such that the platform is supported for omnidirectional movement. A hand securement assembly, which may be in the form of a glove member, is positioned along the top surface and configured to secure a user's hand relative to the top surface such that the user's hand is substantially parallel to the first plane. Each exercise device may include one or more stoppers extending from the bottom of the platform to selectively immobilize the device. A pair of the omnidirectional exercise devices may be joined together to form a system wherein both devices move omnidirectionally in unison.

20 Claims, 6 Drawing Sheets

OMNIDIRECTIONAL EXERCISE DEVICE AND SYSTEM

FIELD OF THE INVENTION

This invention relates to exercise devices. More particularly, the present disclosure relates to omnidirectional exercise devices that provide for omnidirectional movement of the platforms, independently or jointly, while performing various exercises.

BACKGROUND OF THE INVENTION

Over the years physical exercise has grown in popularity to improve the health and physical appearance of a person and also to reduce stress. There are a many forms of physical exercise that may be employed by a person such as: strength training, aerobics, calisthenics, and plyometrics to name a few. A common strength training exercise is the traditional push-up. In performing a push-up, a user assumes a prone position, and lifts the body using the arms. Through this exercise, the weight of the body serves as the main source of resistance to the muscles, particularly the pectoralis muscles, which are used in performing the push-up. However, greater muscle training efficiency may be obtained by activating additional muscle groups while performing the push-up. This is accomplished by modifying the standard up-down motion of the push-up to include various secondary movements such as: leg raises, one-armed push-ups, various hand positions, hip raises and the like. By using such modifications, the user activates various secondary muscle groups, which in turn significantly increase the effectiveness of the physical exercise. Additionally, alternating between push-up exercises and cardiovascular activity may provide additional benefits.

Additionally, exercise efficiency can be further enhanced by random activation of these secondary muscle groups, which induces muscle confusion. It is known that performing the same exercise over and over cause the human body to adapt to these exercise motions and thereby causing a diminishing return by performing the same exercise repeatedly. Consequently, by employing muscle confusion that randomly activates various secondary muscle groups during a particular exercise, the human body is less likely to adapt to the exercise motions and thus receives greater benefit from the exercise.

There are several known devices in the prior art that seek to enhance the overall effectiveness of performing various exercises and in particular the traditional push-up. These devices commonly seek to facilitate one or more secondary motions, which in turn activate additional muscle groups during the core exercise. While these devices have shown some benefits, the devices typically provide a limited specialized activity or require conversion of the device to switch between exercises. Additionally, such devices have typically changed the required positioning of the user's hands and/or wrists away from the natural push-up position.

SUMMARY OF THE INVENTION

Briefly, the present invention provides omnidirectional exercise devices that provide for omnidirectional movement of the platforms, independently or jointly, while performing various exercises.

In one aspect, the invention provides an omnidirectional exercise device including a platform having a top surface and a bottom surface with the top surface extending generally in a first plane. At least one omnidirectional movement assembly is secured relative to the bottom surface such that the platform is supported for omnidirectional movement. A hand securement assembly is positioned along the top surface and configured to secure a user's hand relative to the top surface such that the user's hand is substantially parallel to the first plane.

In another aspect, the invention provides an omnidirectional exercise device including a platform having a top surface and a bottom surface and at least one omnidirectional movement assembly secured relative to the bottom surface such that the platform is supported for omnidirectional movement. Each omnidirectional movement assembly includes at least one reduced friction member with a contact surface at a first distance from the bottom surface. At least one stopper member extends from the bottom surface a second distance which is less than the first distance.

In another aspect, the invention provides an omnidirectional exercise system including a first omnidirectional exercise device including a platform having a top surface and a bottom surface, at least one omnidirectional movement assembly secured relative to the bottom surface such that the platform is supported for omnidirectional movement, and at least one first interlocking member, and a second omnidirectional exercise device including a platform having a top surface and a bottom surface, at least one omnidirectional movement assembly secured relative to the bottom surface such that the platform is supported for omnidirectional movement, and at least one second interlocking member. When the first and second interlocking members are engaged with one another, the first and second omnidirectional exercise devices move omnidirectionally in unison.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
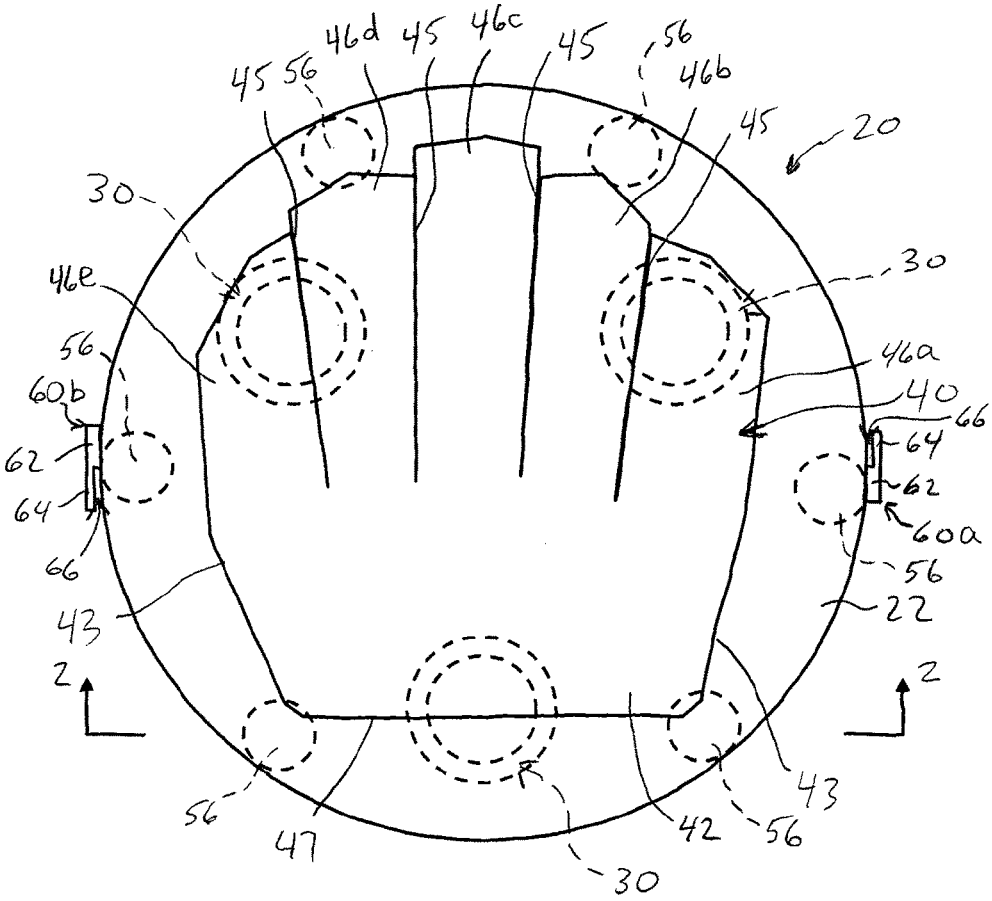
FIG. 1 is a top plan view of an omnidirectional exercise device in accordance with an exemplary embodiment of the present invention.

In the drawings, like numerals indicate like elements throughout. Certain terminology is used herein for convenience only and is not to be taken as a limitation on the present invention. For example, the terms front, back, left and right are utilized herein to assist with understanding of relative positioning, but are not intended to be limiting to an orientation of use of the device. The following describes preferred embodiments of the present invention, however, it should be understood, based on this disclosure, that the invention is not limited by the preferred embodiments described herein.

Referring to FIGS. 1-6, an exemplary embodiment of an omnidirectional exercise system 10 utilizing a pair of omnidirectional exercise devices 20 in accordance with an exemplary embodiment of the present invention will be described. Each exercise device 20 generally comprises a platform 22 with one or more omnidirectional movement assemblies 30 extending from a bottom surface 26 thereof and a hand securement assembly 40 along the top surface 24 thereof. In the illustrated embodiment, the top surface 24 is generally planar and extends in plane T and the bottom surface 26 is generally planar and extends in plane B. The platform 22 is illustrated with a circular configuration, but may be otherwise configured, e.g. square, rectangular, oval, hexagonal, octagonal, etc. and includes three equally spaced movement assemblies 30. More or fewer movement assemblies 30 may be provided and the movement assemblies 30 may be otherwise configured. The number and configuration of the movement assemblies 30 are selected such that the assemblies 30 support the platform 22 in a stable position relative to a workout surface. In the illustrated embodiment, the movement assemblies 30 are positioned radially inward from the perimeter of the platform 22 such that the platform 22 is tiltable in some instances, as described in more detail below.

Figure 2:
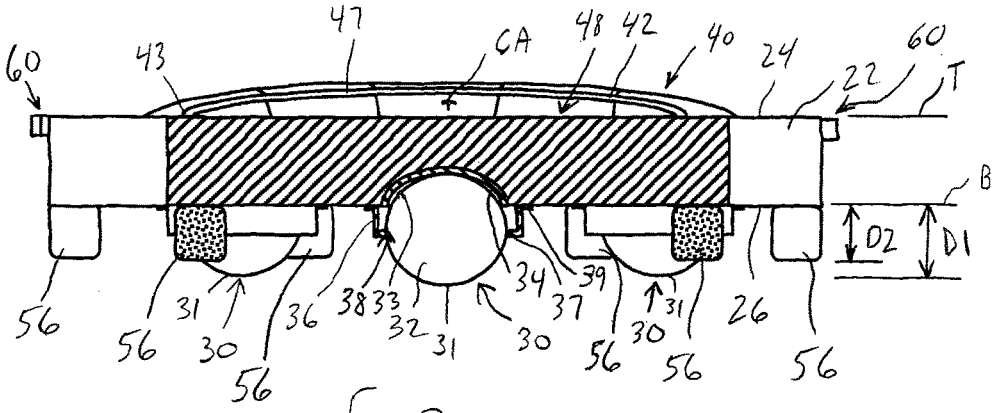
FIG. 2 is a cross-sectional view along the line 2-2 of FIG. 1.

Referring to FIG. 2, each exemplary omnidirectional movement assembly 30 includes a reduced friction member 32 with a contact surface 31 configured to move omnidirectionally relative to a workout surface. In the exemplary embodiment, the reduced friction member 32 is a spherical ball configured to roll relative to the workout surface and a bearing surface 34 of the exercise device 20. The bearing surface 34 may have any low friction configuration, for example, a low friction material, a low friction coating, a plurality of ball bearings or the like.

In the present exemplary embodiment, the bearing surface 34 is defined within a respective cavity 33 on the bottom surface 26 of the platform 22 and the reduced friction member 32 is maintained in position relative to the bearing surface 34 by a housing 36 positioned about the reduced friction member 32. The housing 36 has a surface 37 parallel to the bottom surface 26 with an opening 38 therethrough. The opening 38 has a diameter less than the diameter of the spherical ball of the reduced friction member 32 such that a portion of the spherical ball extends out of the housing 36 but is retained therein. The housing 36 may include a peripheral flange 39 or the like for attachment to the platform 22. While cavities 33 are illustrated, it is contemplated that the bearing surface 34 may extend externally of the platform 22 with the housing 36 configured to accommodate the position of the moving member 32.

Referring to FIGS. 1-4, each exercise device 20 includes a hand securement assembly 40 configured to secure each platform 22 to a respective hand 102 of a user 100. In the present embodiment, each hand securement assembly 40 is in the form of a glove member 42 with a portion of its periphery 43, or other portions of the glove member 42, secured to the top surface 24 of the platform 22. One edge 47 is not secured and defines an opening 48 into the glove member 42. Opposite the open edge 47, the glove member 42 includes stitching 45 or the like to define individual finger pockets 46*a*-46*e*. The outer finger pockets 46*a* and 46*e* are preferably symmetrical such that the pockets 46*a* and 46*e* may receive either a thumb or pinkie, thereby making each of the exercise devices 20 universal to a right hand or left hand. However, it is understood that each glove member 42 may be configured to fit a specific hand such that the respective exercise device 20 is either a right hand device or a left hand device.

The glove member 42 may be manufactured from an elastic material such that it will fit securely on hands of various sizes, however, such elasticity is preferably limited such that the fit will be secure to the user's hand. The glove member 42 may be manufactured from other materials, including inelastic materials. The glove member 42 may be manufactured with other forms of adjustability, e.g. drawstrings, or may be manufactured in different sizes with user's selecting an appropriate size for their hand.

Figure 3:
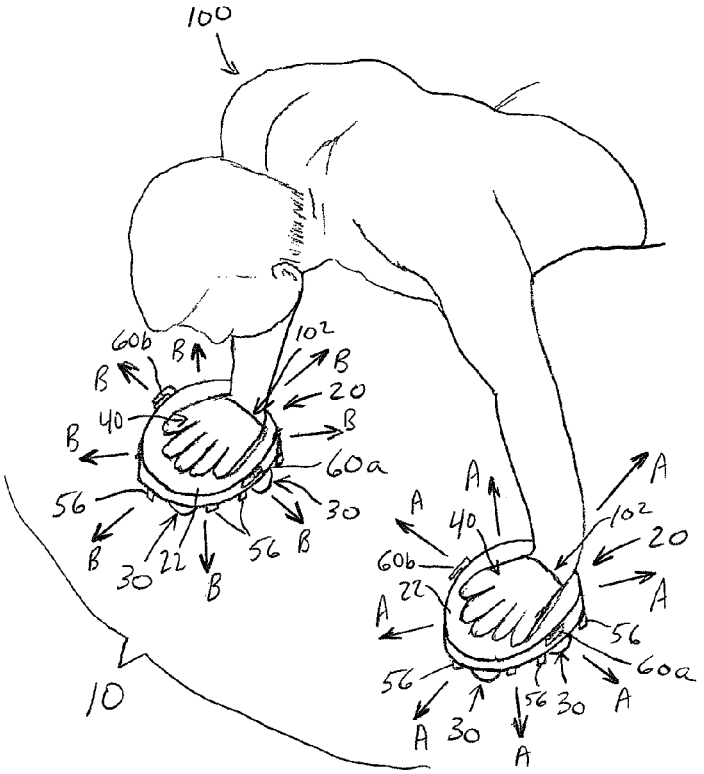
FIG. 3 is a perspective view of a pair of exercise devices of FIG. 1 in an exemplary form of use during a push-up.
Figure 4:
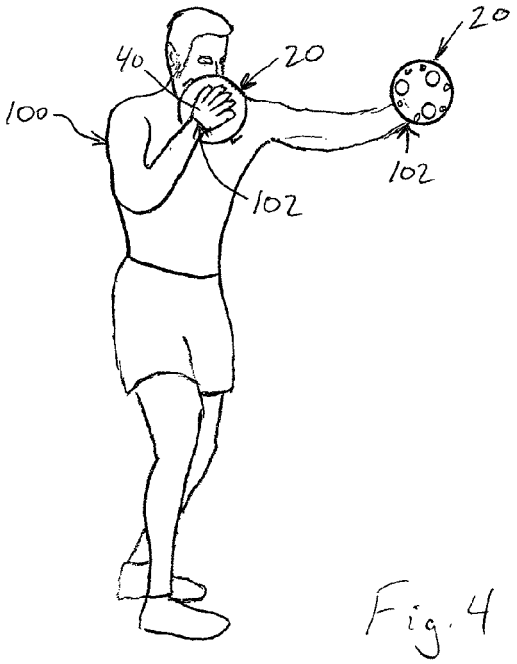
FIG. 4 is a perspective view of a pair of exercise devices of FIG. 1 in an exemplary form of use during a shadow boxing exercise.

The glove member 42 extends along the platform top surface 24 such that a central axis CA of the glove member 42 is substantially parallel to the plane T. As such, when a user 100 positions their hand 102 in one of the glove members 42, the user's hand 102 extends substantially parallel to the top surface 24. When used to do a standard push-up, as illustrated in FIG. 3, the user's arms and hands will be in a natural push-up position. Such a position is seen by many to be a superior position then a straight wrist position. Additionally, each exercise device 20 is independently omnidirectionally moveable as indicated by arrows A and B in FIG. 3 and positioning of each hand 102 along the surface 24 of the platform 22 provides greater control of the omnidirectional movement of each exercise device 20. With such control, the user 100 is typically safer, and therefore more comfortable, in moving the devices 20 over a greater range of motion, making the exercises more effective. As an additional benefit of having the devices 20 securely positioned on the user's hands 102, the user 100 can quickly and easily transition between exercises. For example, the user 100 can move from push-up exercises as illustrated in FIG. 3 to shadow boxing exercises as illustrated in FIG. 4. The exercise devices 20 provide additional weight for the shadow boxing exercises.

Figure 5:
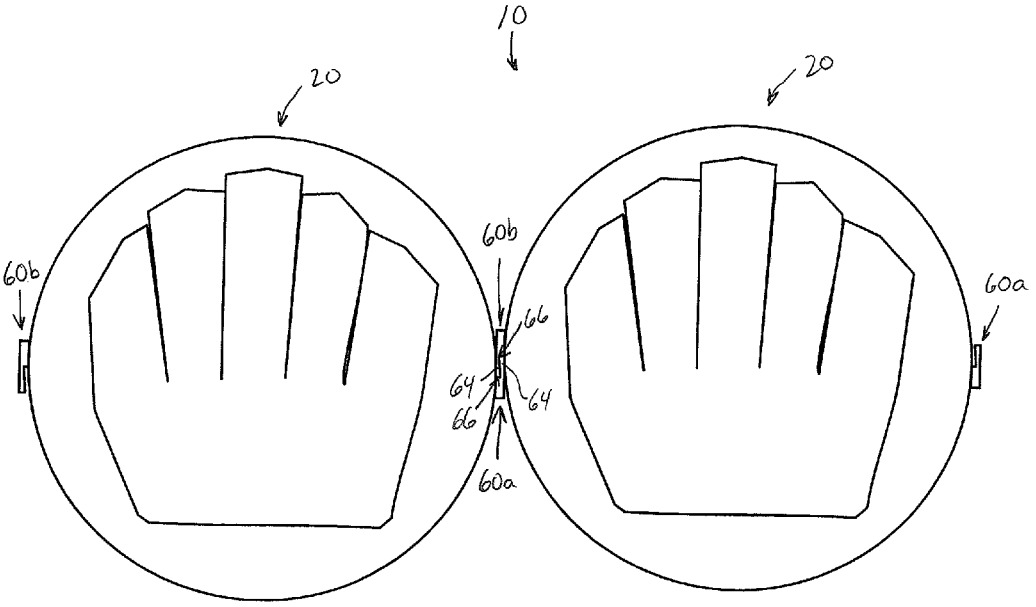
FIG. 5 is a top plan view of a pair of exercise devices of FIG. 1 in a joined configuration.
Figure 6:
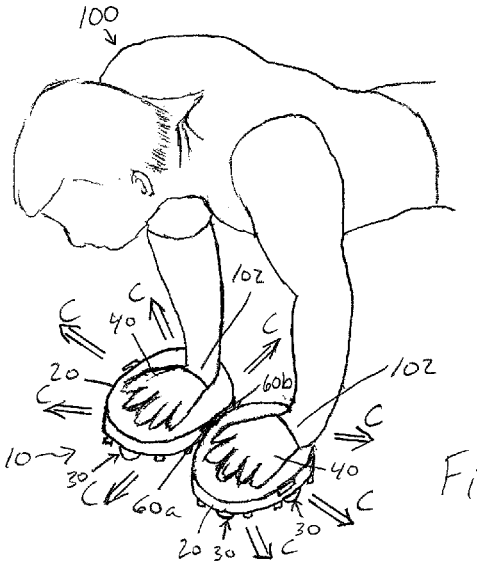
FIG. 6 is a perspective view of a pair of exercise devices of FIG. 1 in another exemplary form of use during a push-up.

Referring to FIGS. 1, 5 and 6, the exercise system 10 is configured to facilitate an additional exemplary exercise which is similar to a diamond push-up. In this regard, each exercise device 20 includes at least one interlocking member 60. In the present embodiment, complimentary interlocking members 60*a*, 60*b* are provided on opposite sides of the platform 22. Such a configuration allows each exercise device 20 to have a universal configuration which can be used on the left and right hands and still be interconnectable to one another. Alternatively, the exercise devices 20 may be formed as a right hand device with the interlocking member 60 on the left side of the platform 22 and a left hand device with the interlocking member 60 on the right side of the platform 22.

Each of the exemplary interlocking members 60*a*, 60*b* includes a body 62 attached to the side of the platform 22 with a projection 64 extending from the body 62 in spaced relation to the platform 22 to define a receiving space 66 between the projection 64 and the platform 22. Each receiving space 66 is configured to receive and retain a projection 64 of another interlocking member 60 as shown in FIG. 5. The projections 64 and the receiving spaces 66 may have complementary tapers to assist in retaining the interlocking members 60 engaged. Other forms of interlocking members, whether universal or not, may be utilized. For example, the interlocking members 60 may take the form of hooks and eyes, hook and loop fastener material, tongues and grooves, magnets and the like.

When the interlocking members 60*a*, 60*b* are engaged with one another, the omnidirectional exercise devices 20 move omnidirectionally in unison as indicated by the double arrows C in FIG. 6. While forms of push-up and shadow boxing exercises are provided as exemplary exercises, it is understood that the devices 20 and system 10 may be utilized in various other exercises.

As mentioned above, controllability of the exercise devices 20 typically allows the user 100 to feel safer and more comfortable which facilitates moving the devices 20 over a greater range of motion, making the exercises more effective. To further enhance controllability of the exercise devices 20, each of the exemplary devices 20 has a plurality of stoppers 56 extending from the bottom surface 26 of the platform 22 as shown in FIGS. 1 and 2. The stoppers 56 are positioned radially outward from the movement assemblies 30, preferably along the outer periphery of the platform 22. The stoppers 56 extend from the bottom plane B a distance D2 which is less than the distance D1 between the bottom plane B and the contact surfaces 31 of reduced friction members 32. With this configuration, when the exercise devices 20 are used in a standard moveable position, i.e. with the platform bottom surface 26 parallel to the workout surface and each of the contact surfaces 31 engaged with the workout surface, the stoppers 56 are spaced from the workout surface and the exercise devices 20 are freely omnidirectionally moveable. If prior to an exercise or in the middle of an exercise the user 100 decides to make one or both of the exercise devices 20 stationary, the user 100 simply tilts the platform 22 until one or more of the stoppers 56 contacts the workout surface. The ability to convert the exercise device 20 to a stationary device without having to change the configuration of the exercise device 20 provides the user with more control and also the possibility of more exercises.

In the illustrated embodiment, the stoppers 56 are equally spaced about the platform 22 with two stoppers 56 positioned between each pair of movement assemblies 30. More or fewer stoppers 56 may be utilized and may be positioned in various configurations. It is contemplated that the stoppers 56 may be removably connected to the platform 22 to allow the user to remove the stoppers 56 if desired, for example, an advanced user that does not need the added control. The stoppers 56 are preferably manufactured from a hardened rubber or the like. Other materials, including hard and soft materials, having varying elasticity may be utilized.

Figure 7:
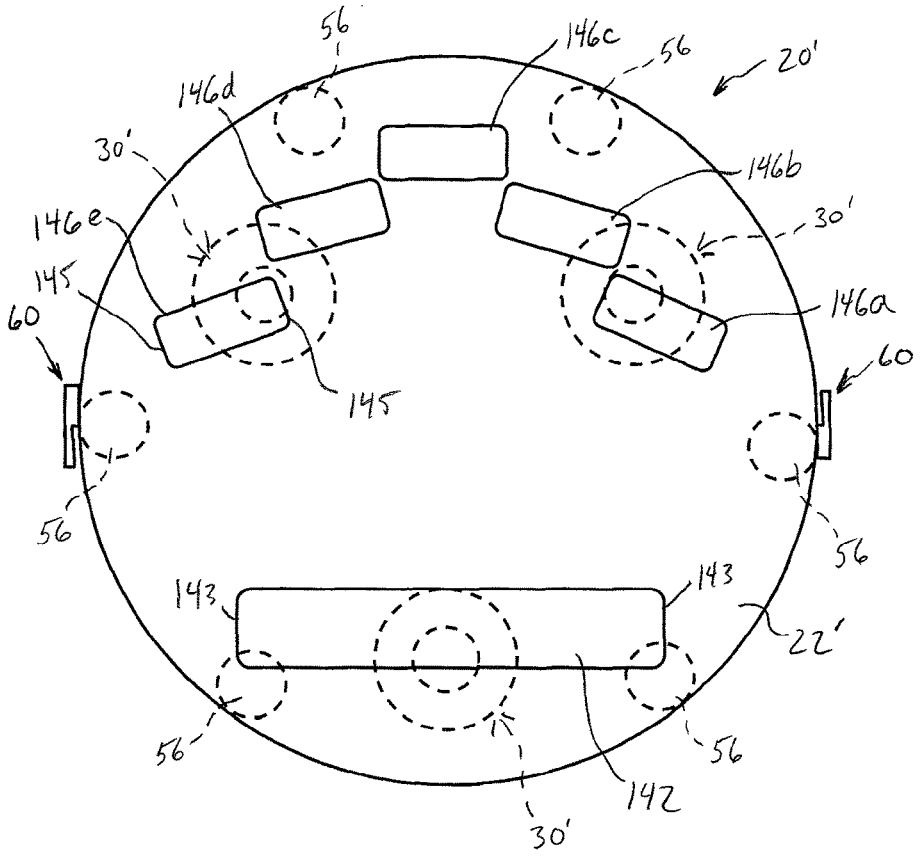
FIG. 7 is a top plan view of an omnidirectional exercise device in accordance with another exemplary embodiment of the present invention.
Figure 8:
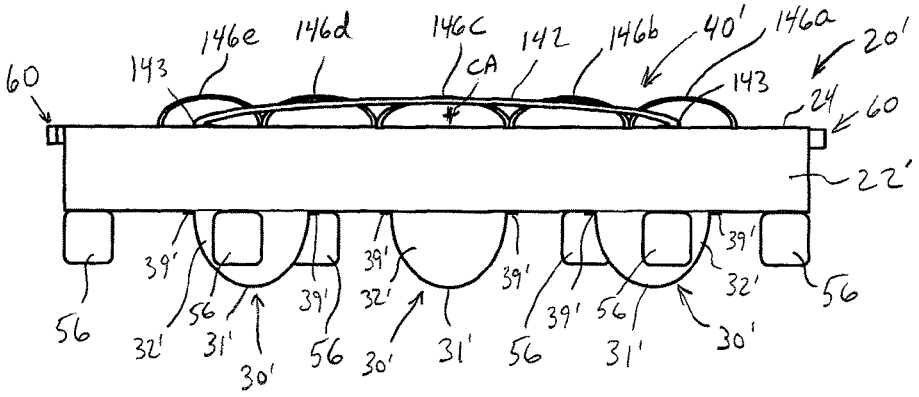
FIG. 8 is a side elevation view of the exercise device of FIG. 7.

Referring to FIGS. 7 and 8, an alternative exemplary exercise device 20' in accordance with an embodiment of the present invention will be described. The exercise device 20' is similar to the device and system as described above and only the differences will be described herein. In one aspect, the movement assemblies 30' of the present embodiment include stationary reduced friction members 32' formed with a low friction contact surface 31'. The low friction contact surface 31' may be formed, for example, from low friction material, a low friction coating or the like. In the illustrated embodiment, the contact surfaces 31' are formed with an arcuate configuration to assist in omnidirectional movement and tilting of the platform 22', however, other configurations may be utilized. The reduced friction members 32' may include a peripheral rim 39' or the like for attachment of the members 32' to the platform 22'. In the present embodiment, the cavities, bearing surface and housing of the pervious embodiment are not required. The movement assemblies 30, 30' are for illustrative purposes and it is understood that the described assemblies as well as other forms of omnidirectional movement assemblies may be utilized in the various embodiments of the invention.

Additionally, in the present embodiment, the hand securement assembly 40' includes a hand strap 142 and five finger straps 146. The hand strap 142 is secured along its lateral edges 143 to the platform 22'. Similarly, each of the finger straps 146 is attached along its lateral edges 145 to the platform 22'. In an alternative configuration, the finger straps 146 are formed via a single strap stitched at spaced intervals to define the individual finger pockets. In the illustrated embodiment, the straps 142 and 146 are manufactured from an elastic material to accommodate differently size hands, however, such elasticity is preferably limited such that the fit will be secure to the user's hand. The straps 142 and/or 146 may be manufactured from other materials, including inelastic materials. The hand strap 142 and/or the finger straps 146 may be manufactured with other forms of adjustability, e.g. buckles or hook and loop fasteners, or may be manufactured in different sizes with user's selecting an appropriate size for their hand.

The hand strap 142 and finger straps 146 are positioned such that a central axis CA of the hand securement assembly 40' is substantially parallel to the plane T. As such, when a user 100 positions their hand 102 in straps 142 and 146, the user's hand 102 extends substantially parallel to the top surface 24.

As in the previous embodiment, the hand securement assembly 40' is preferably universal, i.e. it can receive either a right hand or a left hand, and complementary interlocking members 60 are provided on opposite sides of the platform 22' such that each exercise device 20' is universally useable on either hand. In the event the hand securement assembly 40' is not universal, the interlocking members 60 will be positioned to align with one another, i.e. the right hand device will have an interlocking member on the left side and the left hand device will have an interlocking member of the right side. The exercise devices 20' and system are useable in a manner similar to that described in the previous embodiment.

Figure 9:
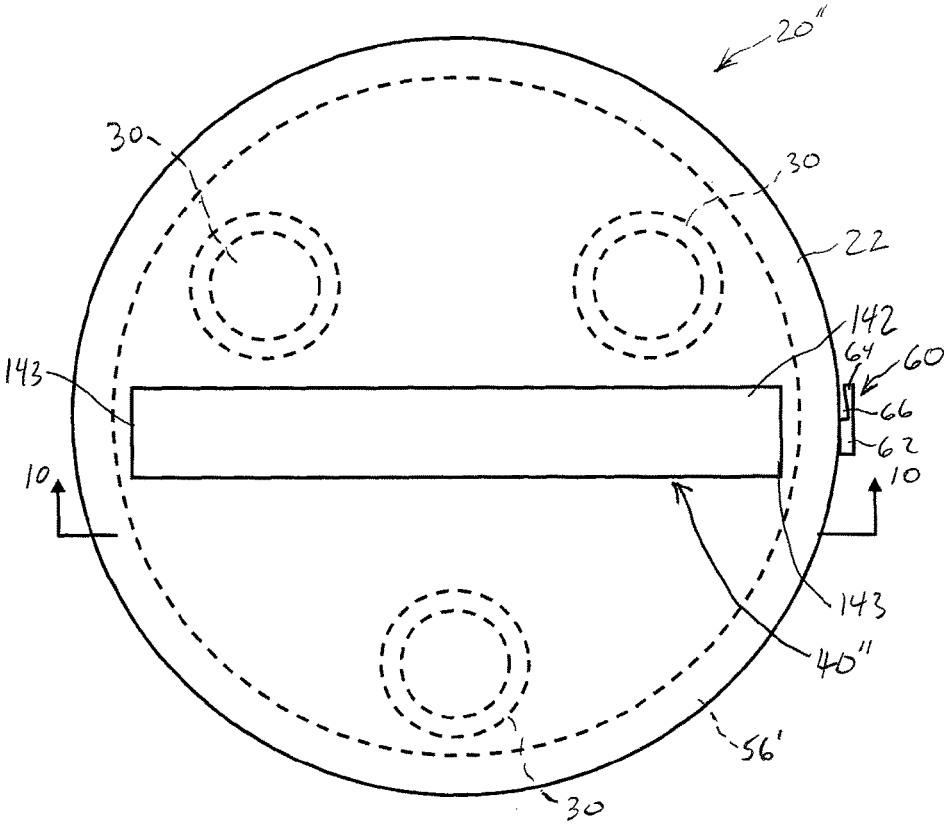
FIG. 9 is a top plan view of an omnidirectional exercise device in accordance with another exemplary embodiment of the present invention.
Figure 10:
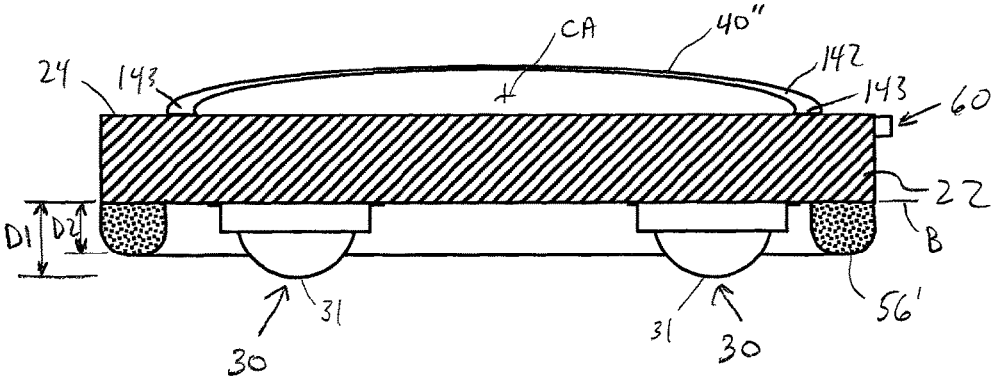
FIG. 10 is a cross-sectional view along the line 10-10 of FIG. 9.
Figure 11:
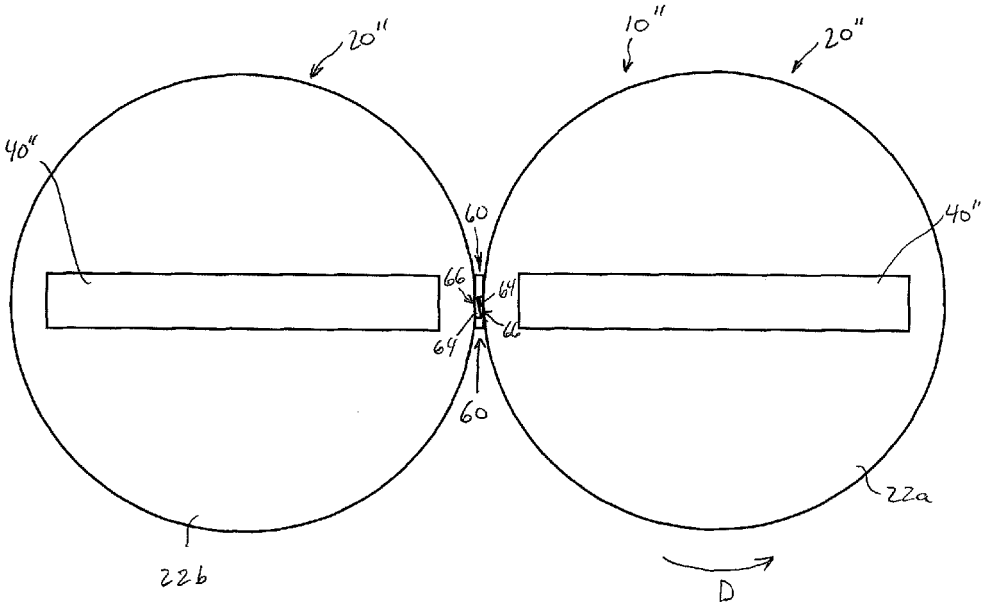
FIG. 11 is a top plan view of a pair of exercise devices of FIG. 9 in a joined configuration.

Referring to FIGS. 9-11, another alternative exemplary exercise device 20" in accordance with an embodiment of the present invention will be described. The exercise device 20" is similar to the devices and systems as described above and only the differences will be described herein. In one aspect, the hand securement assembly 40" is defined by a single hand strap 142 positioned centrally on the platform 22. The hand strap 142 is secured along its lateral edges 143 to the platform 22. In the illustrated embodiment, the hand strap 142 is manufactured from an elastic material to accommodate differently size hands, however, such elasticity is preferably limited such that the fit will be secure to the user's hand. The strap 142 may be manufactured from other materials, including inelastic materials. The hand strap 142 may be manufactured with other forms of adjustability, e.g.

buckles or hook and loop fasteners, or may be manufactured in different sizes with user's selecting an appropriate size for their hand.

The hand strap 142 is positioned such that a central axis CA of the hand securement assembly 40" is substantially parallel to the plane T. As such, when a user 100 positions their hand 102 in the strap 142, the user's hand 102 extends substantially parallel to the top surface 24.

In the present embodiment, only one complementary interlocking member 60 is provided on one side of the platform 22. With the current embodiment, the hand securement assembly 40" is universal relative to the user's hands. To interconnect two devices 20" into the system 10", one of the platforms 22*a* is rotated 180°, as indicated by arrow D in FIG. 11, such the interlocking members 60 are aligned with one another and may be brought into engagement.

Referring to FIG. 10, the stopper 56' of the present embodiment is defined as a continuous peripheral ring. As in the previous embodiments, the stopper 56' extends a distance D2 from the bottom plane B which is less than the distance D1 that the contact surfaces 31 are from the bottom plane B. As such, when the exercise devices 20" are used in a standard moveable position, i.e. with the platform bottom surface 26 parallel to the workout surface and each of the contact surfaces 31 engaged with the workout surface, the stopper 56' is spaced from the workout surface and the exercise devices 20" are freely omnidirectionally moveable. Again, prior to an exercise or in the middle of an exercise, the user 100 may make one of the exercise devices 20" stationary by tilting the platform 22 until a portion of the stopper 56' contacts the workout surface. The exercise devices 20" and system 10" are useable in a manner similar to that described in the previous embodiment.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. An omnidirectional exercise device comprising:

a platform having a top surface and a bottom surface, the top surface extending generally in a first plane;

at least one omnidirectional movement assembly secured relative to the bottom surface to support the platform for omnidirectional movement; and a hand securement assembly positioned along the top surface and configured to secure a user's hand relative to the top surface such that the user's hand is substantially parallel to the first plane.

2. The omnidirectional exercise device according to claim 1 wherein the hand securement assembly is defined by a glove member attached to the top surface.

3. The omnidirectional exercise device according to claim 2 wherein the glove member includes an opening opposite a plurality of finger pockets.

4. The omnidirectional exercise device according to claim 3 wherein the glove member is configured to universally receive a right hand or left hand.

5. The omnidirectional exercise device according to claim 2 wherein the glove member is adjustable.

6. The omnidirectional exercise device according to claim 1 wherein the hand securement assembly is defined by at least one strap attached to the top surface.

7. The omnidirectional exercise device according to claim 6 wherein the at least one strap is positioned in the center of the platform.

8. The omnidirectional exercise device according to claim 1 wherein the hand securement assembly is defined by a hand strap and at least one finger strap.

9. The omnidirectional exercise device according to claim 8 wherein the at least one finger strap defines individual finger pockets.

10. The omnidirectional exercise device according to claim 1 wherein the hand securement assembly defines a hand receiving cavity having a central axis which is substantially parallel to the first plane.

11. An omnidirectional exercise device comprising:

a platform having a top surface and a bottom surface;

at least one omnidirectional movement assembly secured relative to the bottom surface to support the platform for omnidirectional movement, each omnidirectional movement assembly including at least one reduced friction member with a contact surface spaced at a first distance in a first direction from the bottom surface; and at least one stopper member extending from the bottom surface a second distance in the first direction which is less than the first distance.

12. The omnidirectional exercise device according to claim 11 wherein the at least one stopper is defined by a continuous ring extending about a periphery of the platform.

13. The omnidirectional exercise device according to claim 11 comprising a plurality of stoppers radially spaced about a periphery of the platform.

14. The omnidirectional exercise device according to claim 11 wherein the at least one omnidirectional movement assembly is positioned radially inward of the at least one stopper.

15. The omnidirectional exercise device according to claim 11 wherein the at least one stopper is manufactured from a hardened rubber material.

16. The omnidirectional exercise device according to claim 11 wherein the at least one stopper is selectively attachable and removable from the platform.

17. An omnidirectional exercise system comprising:

a first omnidirectional exercise device including a platform having a top surface and a bottom surface, at least one omnidirectional movement assembly secured relative to the bottom surface to support the platform for omnidirectional movement, and at least one first interlocking member, and a second omnidirectional exercise device including a platform having a top surface and a bottom surface, at least one omnidirectional movement assembly secured relative to the bottom surface to support the platform for omnidirectional movement, and at least one second interlocking member, wherein when the first and second interlocking members are engaged with one another, the first and second omnidirectional exercise devices move omnidirectionally in unison.

18. The omnidirectional exercise system according to claim 17 wherein the first and second exercise devices have identical configurations.

19. The omnidirectional exercise system according to claim 18 wherein each exercise device has a pair of complementary first and second interlocking members positioned on opposite sides of the platform.

20. The omnidirectional exercise system according to claim 18 wherein each exercise device has a single interlocking member and the exercise devices are rotated 180° relative to one another to align the first and second interlocking members.

* * * * *